US005910263A

United States Patent [19]

Weiffenbach et al.

[11] Patent Number: 5,910,263

[45] Date of Patent: Jun. 8, 1999

[54] DEVICE FOR BINDING SHEETS BY HEATING

[75] Inventors: Wolfgang Weiffenbach, Bernau; Kurt Leute, Blumberg, both of Germany

[73] Assignee: Ibico AG, Zurich, Switzerland

[21] Appl. No.: 08/944,285

[22] Filed: Oct. 6, 1997

[30] Foreign Application Priority Data

Oct. 7, 1996 [EP] European Pat. Off. ..... 96810673

[51] Int. Cl.[6] ..... H05B 1/00; B42B 5/00

[52] U.S. Cl. ..... 219/221; 412/9; 412/33; 412/11; 219/492

[58] Field of Search ..... 219/221, 497, 219/481, 492, 9; 412/33, 11

[56] References Cited

U.S. PATENT DOCUMENTS

| | | | |
|---|---|---|---|
| 3,863,596 | 2/1975 | Anderson | 118/667 |
| 4,678,386 | 7/1987 | Wiholm | 412/8 |
| 4,855,612 | 8/1989 | Koga et al. | 307/140 |
| 4,863,332 | 9/1989 | Wilholm et al. | 412/37 |
| 5,035,561 | 7/1991 | Loibl | 412/33 |
| 5,120,176 | 6/1992 | Bhatia et al. | 427/245 |
| 5,219,453 | 6/1993 | Furukawa et al. | 412/33 |
| 5,229,578 | 7/1993 | Kusano et al. | 219/497 |
| 5,250,985 | 10/1993 | Ishii et al. | 399/16 |
| 5,252,018 | 10/1993 | Kitahara et al. | 412/11 |
| 5,256,859 | 10/1993 | Nanos et al. | 219/492 |
| 5,275,520 | 1/1994 | Yano et al. | 412/20 |
| 5,355,207 | 10/1994 | Yano et al. | 399/408 |
| 5,365,040 | 11/1994 | Oka | 219/497 |
| 5,420,396 | 5/1995 | Itoh et al. | 219/497 |
| 5,454,680 | 10/1995 | Lazar | 412/41 |
| 5,735,659 | 4/1998 | Kosasa et al. | 412/9 |

FOREIGN PATENT DOCUMENTS 09269696 10/1997 Japan .

*Primary Examiner*—John A. Jeffery
*Assistant Examiner*—Vinod D Patel
*Attorney, Agent, or Firm*—Stroock & Stroock & Lavan LLP

[57] ABSTRACT

The device includes an elongated electrical heating unit (20) whose length matches the length of an elongated opening in the device, and has a switching system to activate an electrical circuit at the moment when sheets to be bound are placed on the heating unit (20). Heating unit (20) is wired in series with a switch (11) in the switching system and a heating current switch (31). Means are provided to keep this heating current switch (31) turned on when the switching system is turned on. The device includes a comparator (34) whose input is connected to a temperature sensor (26); when a predetermined upper temperature limit ($T_{max}$) is reached it turns off the heating current switch (31). There is also a provision so that after the heating current switch (31) is turned off it is kept off until the switch (11) in the switching system has been switched off and then on again.

10 Claims, 6 Drawing Sheets

DEVICE FOR BINDING SHEETS BY HEATING

BACKGROUND OF THE INVENTION

The present invention pertains to a device for binding sheets by heating.

A device of this type is known for example from EP-B1-0 508 945. This device includes an elongated electrical heating apparatus whose length corresponds to the length of a longitudinal opening in the device, and a provision for switching in order to activate an electrical circuit at the moment when the binding is placed on the heater.

The functioning of this device is such that during the time which it take after the power is switched on before the heater has warmed up, an audible or visible alarm signal is given. The heater itself includes PTC thermistor elements, however, and is consequently self-regulating.

In another device of this type in accordance with DE-C2-38 05 996, there is provision for a computer which can be used together with a probe to sense the width of the covers which are inserted into the opening between the supports and to determine the moment for switching on the timer for the heating element on the basis of this information.

Devices of this sort can be used advantageously for manufacturing book bindings, brochures and the like, or for similar tasks, by gluing the back of a stack of loose sheets against the spine of a binding folder, using a thermoplastic adhesive and applying heat. The sheets can be of paper, cardboard, plastic and/or the like. Naturally such devices are also suitable for enabling the bonding of two or more sheets to each other and/or to the spine of a folder.

The known devices of this type are rather complicated and costly, however, and so it is an object of the present invention to improve on such a device.

SUMMARY OF THE INVENTION

Generally speaking, in accordance with the invention, a device for binding sheets by heating is provided. The device can include an elongated electrical heating portion whose length matches the length of an elongated opening on the device and a switching system to activate an electrical circuit at the moment when the binding is placed on the heating apparatus. The heating apparatus can be wired in series with a switch in the switching system and a heating current switch. In addition, there can be a device provided so that when the switching system is switched on, the heating current switch is held in the on position. The device can also include a comparator whose input side is connected to a temperature sensor which measures the temperature of the heater. When a predetermined upper temperature threshold ($T_{max}$) is reached, the comparator can switch the heating current switch off.

Accordingly, it is an object of the invention to provide an improved device for heat binding sheets.

Another object of the invention is to provide a device for heat binding sheets which is less complicated than conventional devices.

Still other objects and advantages of the invention will in part be obvious and will in part be apparent from the specification and drawings.

The invention accordingly comprises the features of construction, combinations of elements, and arrangements of parts which will be exemplified in the constructions hereinafter set forth, and the scope of the invention will be indicated in the claims.

BRIEF DESCRIPTION OF THE DRAWINGS

For a fuller understanding of the invention, reference is had to the following description, taken in connection with the accompanying drawings, in which.

DETAILED DESCRIPTION OF THE PREFERRED EMBODIMENTS

Figure 1:
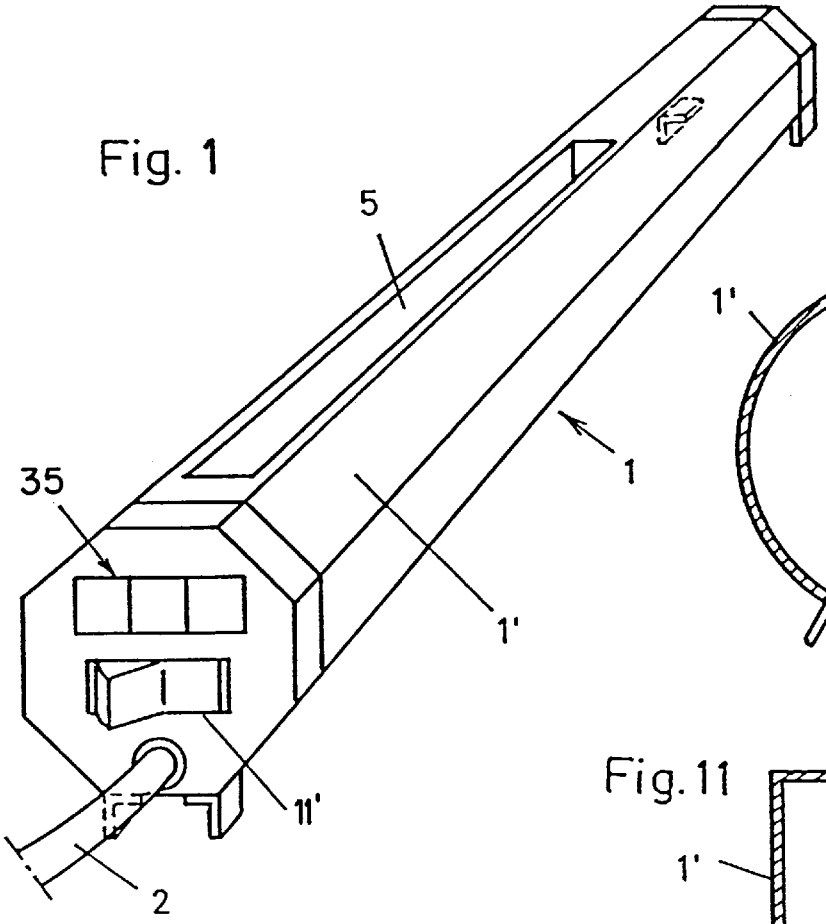
FIG. 1 is a perspective view of the housing of a device in accordance with an embodiment of the invention.
Figure 2:
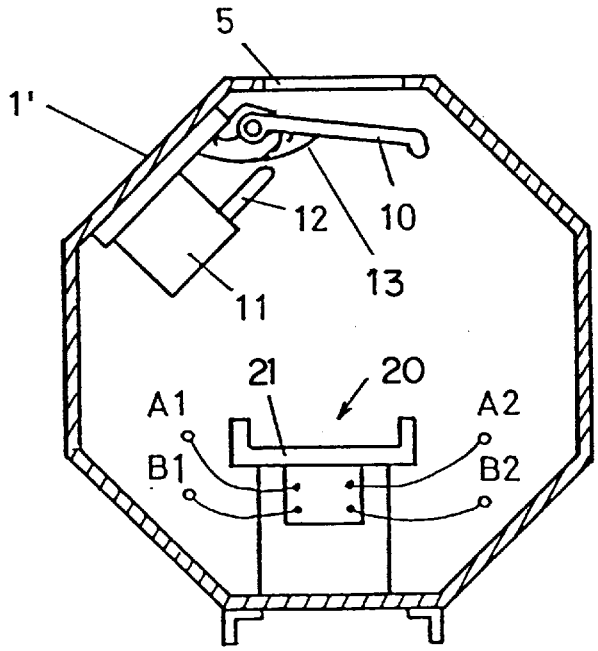
FIG. 2 is a cross-sectional view of a device for heat binding sheets in accordance with a first embodiment of the invention.

The device for binding sheets depicted in FIGS. 1 and 2 shows a basic body housing 1 with an octagonal cross-section. On the face of basic body 1 is a cable connector 2, a switch 3 and a control panel 4. On the top of the basic body 1 is an elongated slot 5, whose width is at least approximately that of a heater 6, which includes a heat-conducting rail 7, preferably formed of aluminum. On the inner side (FIG. 2) of one side wall 1' of basic body 1, there are at least two supports, attached a selected distance apart, for an elongated flap 10 which can pivot at its side, and a switch 11 which is activated by means of a movable pin 12 as flap 10 pivots. A spring 13 holds flap 10 in an elevated position, in which switch 11 is not turned on.

Figure 3:
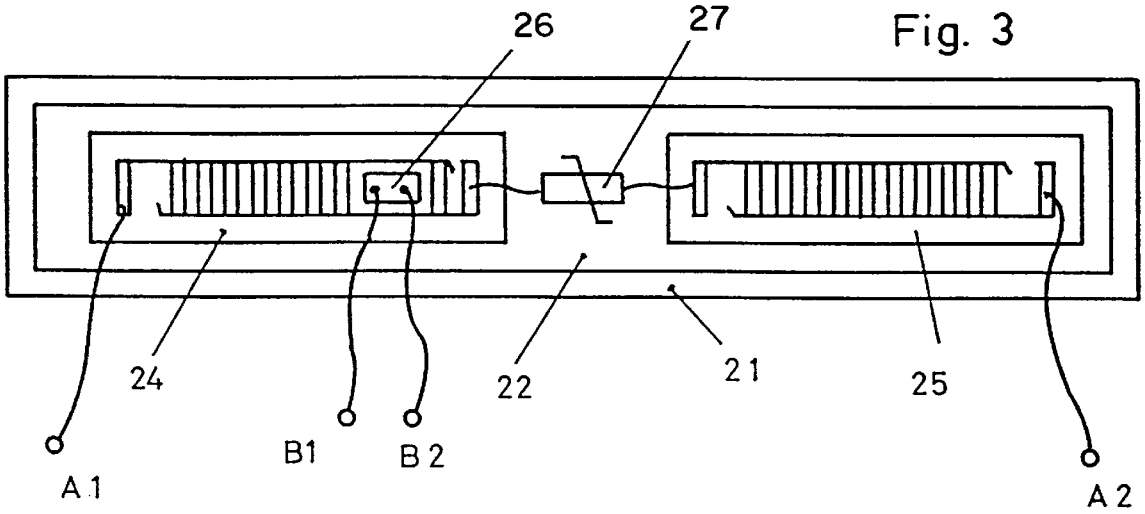
FIG. 3 is a schematic view of a heating apparatus for a heat binding device in accordance with an embodiment of the invention.
Figure 4:
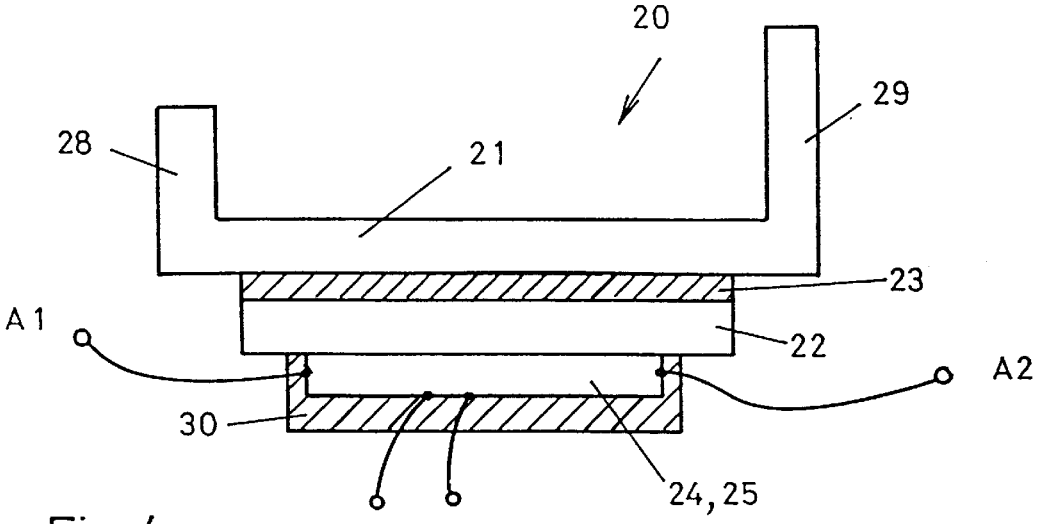
FIG. 4 is a schematic cross-sectional view of a heating apparatus of a heat binding device in accordance with an embodiment of the invention.

A heater 20, for use in a device such as binding device 1, is shown in FIGS. 3 and 4 and includes an elongated metal rail 21, preferably formed of aluminum, with an approximately U-shaped cross section, as shown in FIG. 4. On the under side of rail 21 is a ceramic carrier 22, which is bonded to the flat side of rail 21 by means of a heat-conductive adhesive 23, preferably one which forms a relatively thin layer.

Mounted on carrier 22 are preferably two resistors 24, 25, which are wired in series through a fuse 26. Resistors 24 and 25 have two connectors A1, A2 for the heating current. Attached to resistor 24 is a temperature probe or sensor 27 with two connectors B1, B2; the preferred location is more than ¼, (at approximately ⅓) of the distance from one end of rail 21. Rail 25 has two legs, 28 and 29 with leg 28 shorter than leg 29. The sheets which are to be bound are inserted vertically into the space between legs 28 and 29. The resistors are protected by a glass insulation guard 30.

Figure 5:
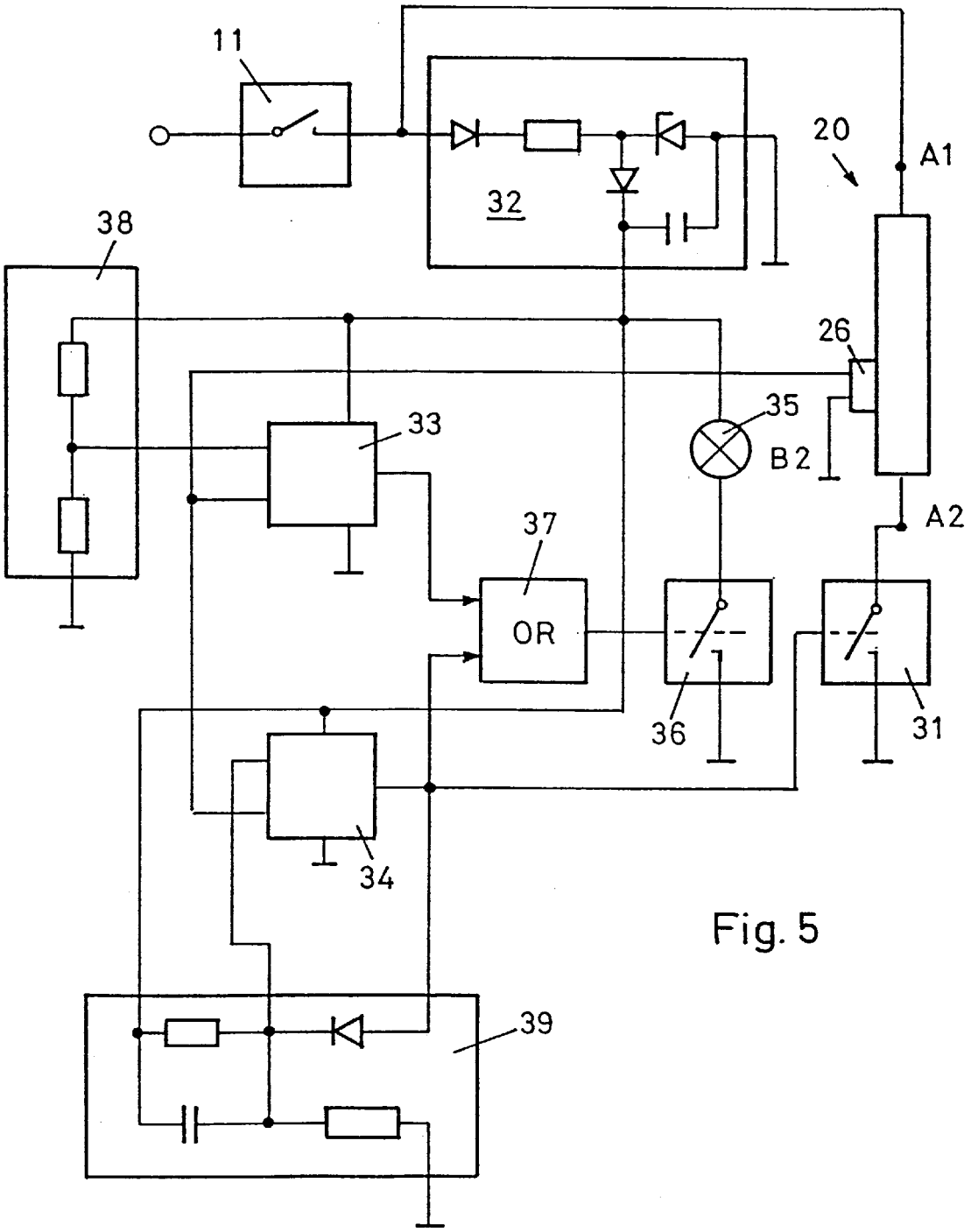
FIG. 5 is a block diagram of the electronics for a heat binding device in accordance with an embodiment of the invention.

The block diagram of FIG. 5 shows switch 11 (FIG. 2) and heating apparatus 20 with sensor 27. Switch 11 is connected to ground via the series wiring of heating unit 20 and a heating current switch 31. A rectifier 32 connected to switch 11 supplies the current for a pair of comparators 33, 34 and for a display element 35, preferably a luminous tile or a red LED, which is connected to ground through an additional switch 36. The electronics include an OR gate 37 which is connected on its input side with one output each from comparators 33, 34 and whose output signal controls switch 36. The output signal of sensor 26 is applied to the comparators 33 and 34. The reference voltage input of comparator 33 is connected to a reference voltage circuit 38, preferably a voltage divider, which is connected to the output of the rectifier 32.

The reference voltage input of comparator 34 is connected to an interlock circuit or latch 39, which is connected to the output of rectifier 32 and looped back to the output of comparator 34.

Figure 6:
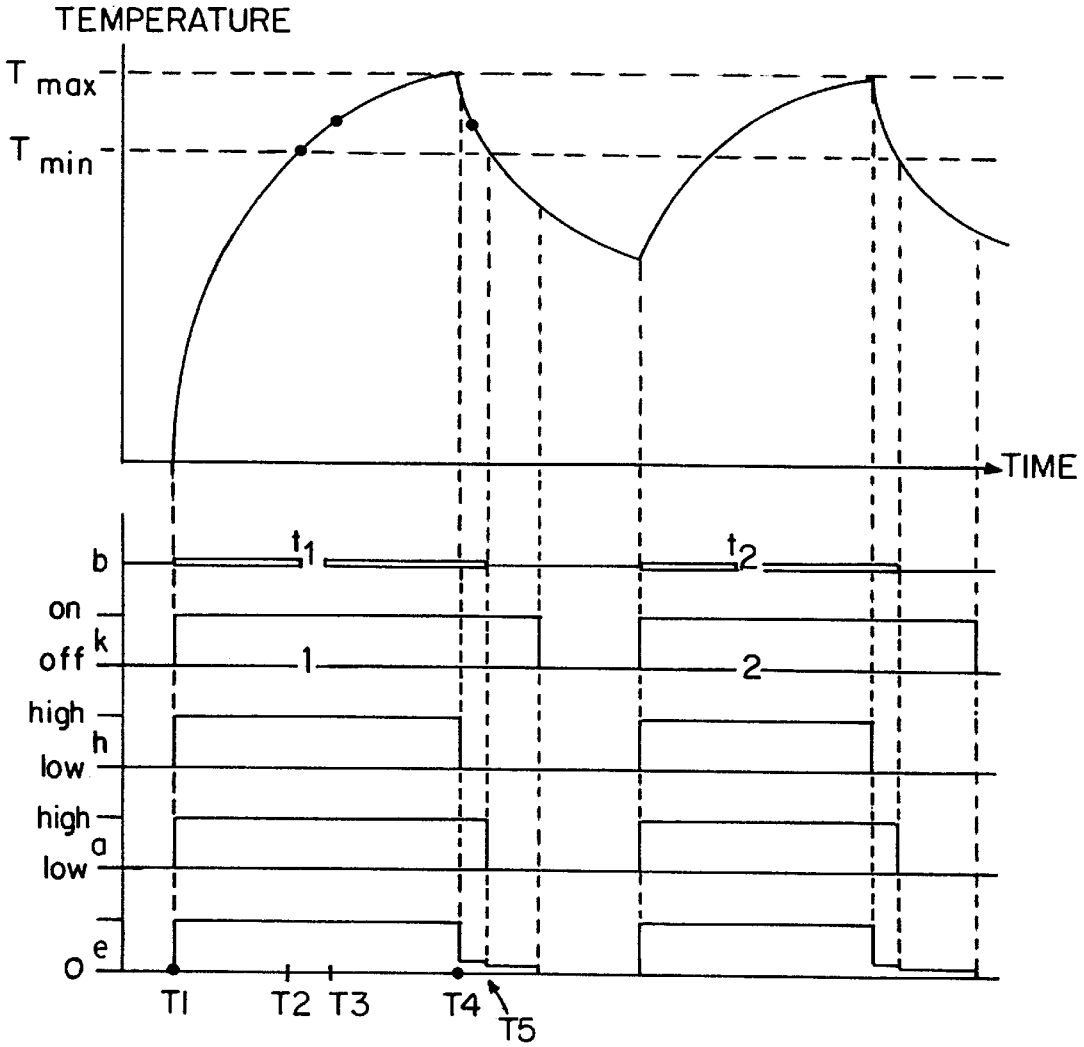
FIG. 6 is a graphic diagram illustrating the operating of a heat binding device in accordance with an embodiment of the invention.

The device illustrated in FIGS. 1–5 operates as follows:

When sheets to be bound are introduced through elongated sheet receiving opening 5, main switch 11 is activated. Referring to FIGS. 5 and 6, the output signal of comparator 34 is "high", the heating current switch 31 is closed (signal b in FIG. 6) and heating current flows through heating unit 20. This corresponds to the condition at time T1 in FIG. 6. At this moment, because of OR gate 37, there is also a signal "high" (signal a) at the input of additional switch 36, so that the display element 35 is activated or illuminated.

The pattern of temperature rise depends upon the constant mass of the rail and the mass of the inserted sheets, which can vary. At a process temperature of about 140° C. the glue begins to liquefy. This corresponds to the time T3 (signal b). Earlier, at a temperature T2, which corresponds to a predetermined time $T_{min}$, comparator 33 becomes active and emits a signal "high", which is of no significance to the heating process itself.

The reference voltage of comparator 34 is predefined so that at a sensor temperature $T_{max}$, its output signal goes to "low" and heating current switch 31 (signal h) is switched off. This corresponds to time T4 in FIG. 6. The temperature then drops due to the natural cooling of the device. As long as $T>T_{min}$ the comparator 33 emits an output signal "high" and additional switch 36 remains closed; i.e., display element 35 burns until $T<T_{min}$ is reached. Then, i.e. at time T5 (FIG. 6), it is extinguished.

Because of the loopback of comparator 34, heating current switch 31 remains open even when $T<T_{max}$, has been reached so that the heating effect lasts only from time T1 to time T4. During this time, the energy usage (curve e, FIG. 6) is at its greatest.

The device remains on as long as sheets remain inserted and by pressing down on flap 10 (curve k, FIG. 6), hold main switch 11 closed. When the bound sheets are removed, the current is interrupted; the interlock circuit loses its effect, for example through the discharge of a condenser, and the process can begin again. If another binding process follows immediately, the processing time (binding time) is shorter, since the heater will still be somewhat warm.

This process itself provides good adjustment of the heating power to the thickness of the stack of sheets, without any need for special regulating circuits and also without time measurements. It also makes rapid heating possible without a pre-heating phase. The heating system is in operation during the period from T3 to T5 (FIG. 6).

Figure 13:
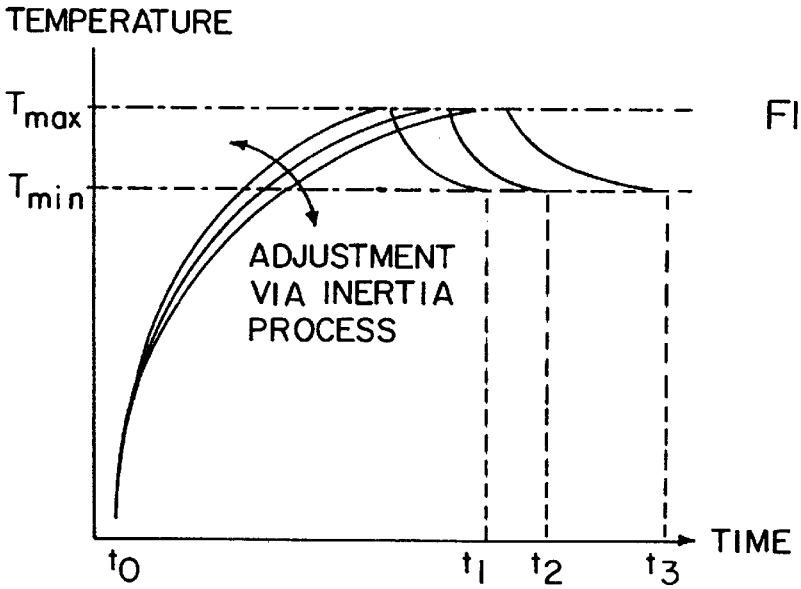
FIG. 13 is a schematic representation, illustrating the automatic adjustment of the binding time.

With greater stack thicknesses, the temperature gradient is smaller because of the inertia of the system (FIG. 13); in other words, the time period T5-T3 become greater and the heating unit 20 remains switched on longer. This is desirable with the greater stack thickness. This automatically produces the necessary duration of the heating process as a function of the thickness of the stack. Since the process is regulated through $T_{max}$ and $T_{min}$, the binding time is adjusted automatically.

Furthermore, during the waiting periods, the energy usage is zero. The bound sheets can be removed as soon as display element 35 is no longer burning, because the process is then completed. The bound sheets can continue to remain in the device, however, for example if they have been forgotten, because the heating unit is switched off, so that the bound sheets will not be damaged by overheating.

Figure 7:
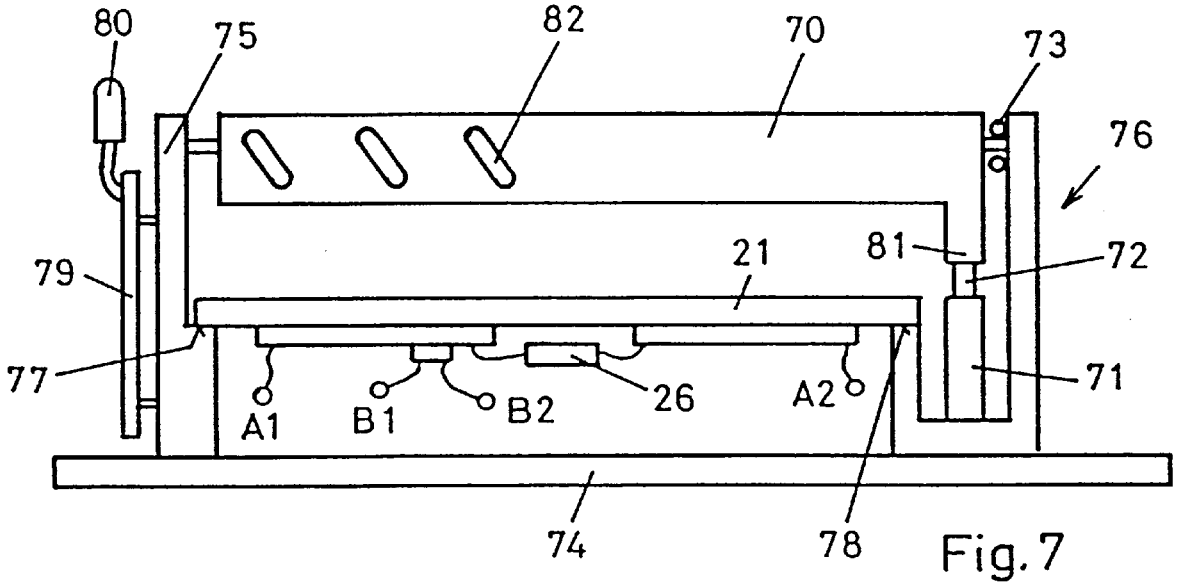
FIG. 7 is a schematic representation of a heat binding device according to an embodiment of the invention.

In another embodiment of the invention, the device shown in FIG. 7 includes a narrow, pivoting wall or flap 70 as a cover for longitudinal elongated sheet receiving opening 5. As it pivots, flap 70 activates a switch 71 or a lever 72. A spring 73 holds flap 70 closed against the opening of the housing. Attached at the ends of an elongated base plate 74 are mounts 75, 76, preferably of plastic, which have shoulders 77 and 78, respectively, which support the ends of rail 21. Switch 71, with its spring-loaded lever 72, is located in a cavity in the mount 76. Attached vertically to mount 75 is a printed circuit board 79, containing the electronics (which are not shown in FIG. 7), as well as an upper display element 80 and/or an acoustic signal element. Flap 70, which is installed between mounts 75 and 76 in such a way that it can pivot longitudinally along its side, has a rounded extension 81 which presses lever 72 downward as it rotates, in order to turn on switch 71.

Figure 8:
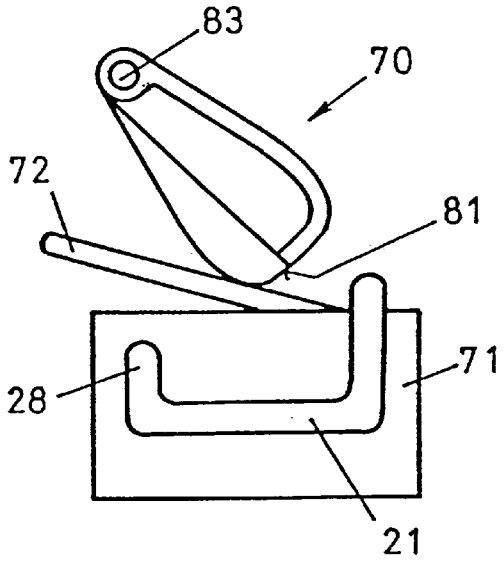
FIG. 8 is a schematic representation illustrating the working of a flap portion of the device of FIG. 7 at the beginning of its motion.
Figure 9:
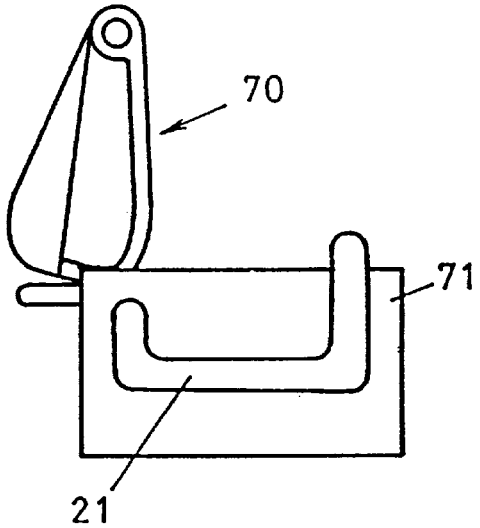
FIG. 9 is a schematic representation of the flap of FIG. 8 when the switch is closed.
Figure 12:
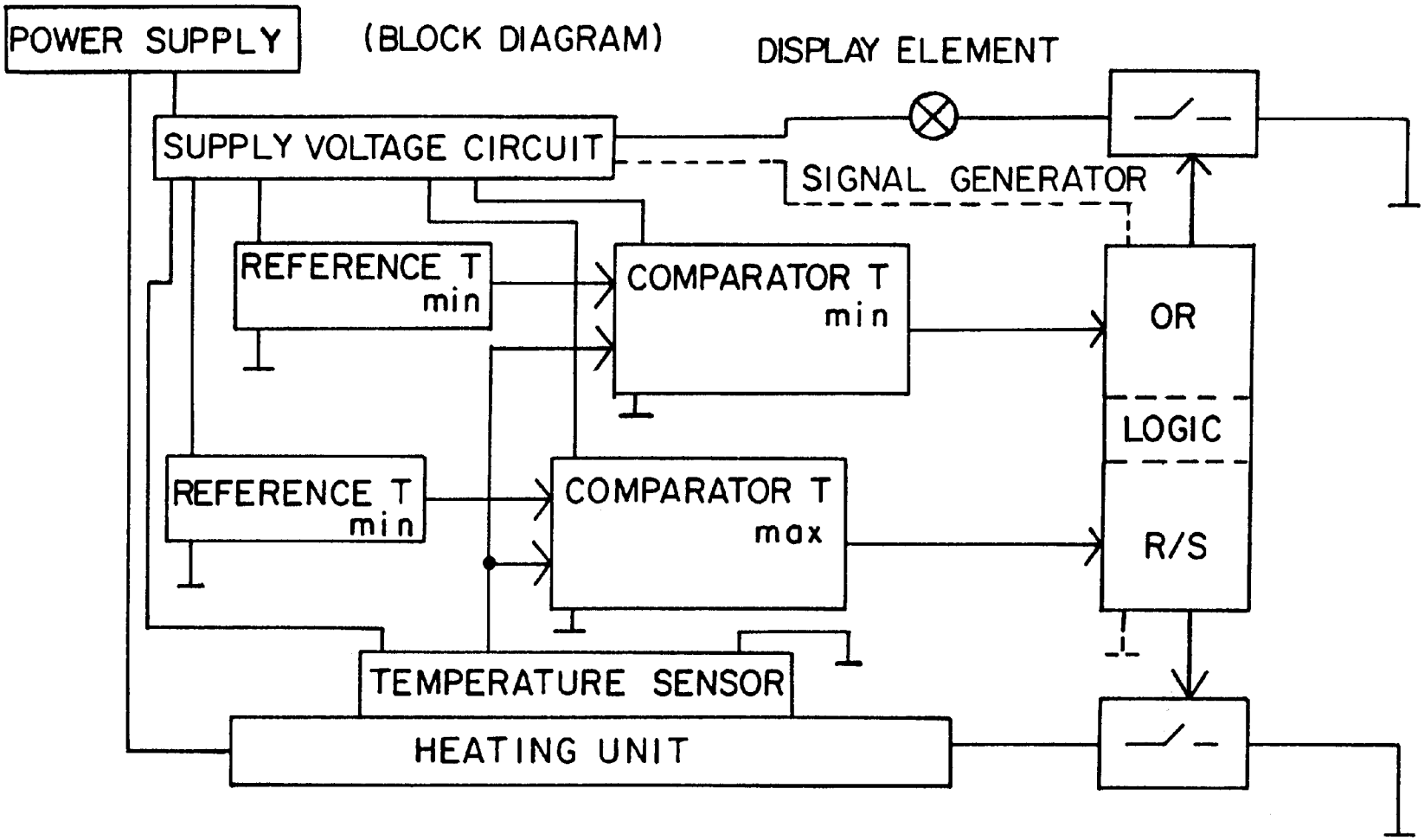
FIG. 12 is a block diagram of the electronics for a heat binding device in accordance with an embodiment of the invention.

FIGS. 8 and 9 show the relative position of rail 21 in relationship to switch 71. FIG. 8 shows schematically the start of the pivoting motion of flap 70 when extension 81 is beginning to apply pressure to lever 72. FIG. 9 shows switch 71 in its closed position.

It is preferable for flap 70 to have diagonal slits 82, which are provided to make it easier for warm air to pass therethrough. Flap 70 can be slightly arched in the middle part of its cross section and relatively strongly curved at the outer edge. The outer covering surface of extension 81 and of the curved part of flap 70 form a cross section with a circular arc centered at the axis of rotation 83 of flap 70, which is above shorter U leg 28 of rail 21.

An additional advantage of a device in accordance with this invention is that input external switch 11' (FIG. 1) can be dispensed with, because the electronics which constitute part of the invention make switch 11 or 71 sufficient to control the desired heating cycle.

In addition, temperature sensor 26 does not have to be very precise in its operation. For example, sensors which are already known, which have a PCT or NTC resistor, can be used. Heating current switch 31 is preferably a TRIAC switch.

Figure 10:
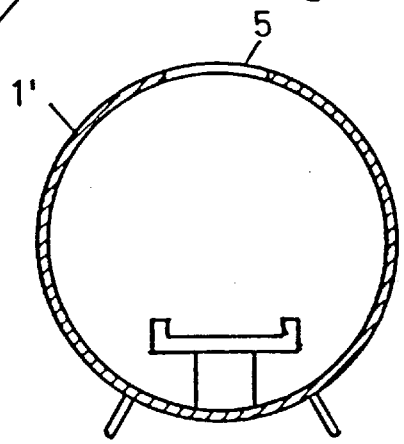
FIG. 10 is a schematic representation of a housing of a heat binding device in accordance with an embodiment of the invention with a round cross-section.
Figure 11:
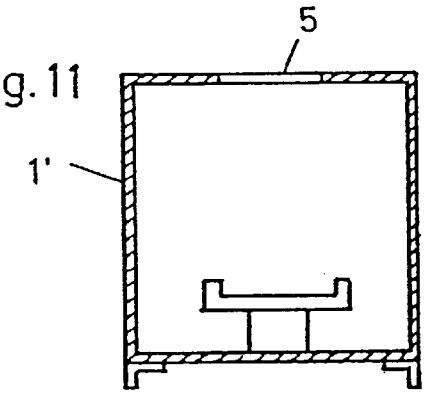
FIG. 11 is a schematic representation of a housing of a heat binding device in accordance with an embodiment of the invention with a square cross-section.

FIGS. 10 and 11 show examples of housings with round and square cross sections, respectively.

As evident from the above, the device can include an elongated electrical heating unit (20) whose length matches the length of an elongated sheet receiving opening in the device, and can have a switching system to activate an electrical circuit at the moment when sheets to be bound are placed on the heating unit 20. Heating unit (20) can be wired in series with a switch (11) in the switching system and a heating current switch (31). Means can be provided to keep this heating current switch (31) turned on when the switching system is turned on. The device can include a comparator (34) whose input is connected to a temperature sensor (26); when a predetermined upper temperature limit ($T_{max}$) is reached it can turn off the heating current switch (31). There can also be a provision so that after the heating current switch (31) is turned off it is kept off until the switch (11) in the switching system has been switched off and then on again.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A device for binding sheets by heating, in which at least one sheet has adhesive on the edge which is to be bound, comprising:

a housing having an elongated sheet receiving opening therein;

an elongated electrical heating unit within the housing, whose length matches the length of the elongated sheet receiving opening;

a switching system to activate an electrical circuit when the sheets to be bound are placed on the heating unit, the heating unit being wired in series with a switch in the switching system;

a heating current switch;

means provided so that when the switching system is switched on, the heating current switch is maintained in the on position;

a temperature sensor constructed to measure the temperature of the heating unit and a comparator whose input side is connected to the temperature sensor, the comparator constructed so that when a predetermined upper temperature threshold ($T_{max}$), which is a preselected temperature to obtain the desired heating of the adhesive to achieve proper binding, is measured, the comparator switches the heating current switch off;

whereby the heating unit will remain on long enough to properly soften the adhesive, but not longer than is desired.

2. The device of claim 1, including means so that when the heating current switch is switched off, it is kept off, even if the switch in the switching system stays on, until the switch in the switching system has been switched off and then on again.

3. The device of claim 1, including a display element, an additional switch and an additional comparator with its input connected to the temperature sensor, constructed so that when the temperature of the heating unit falls below a predetermined minimum threshold ($T_{min}$) the additional comparator supplies a control signal for the additional switch, which activates the display element, which is connected through a rectifier circuit to the switching system.

4. The device of claim 3, wherein the outputs of the two comparators are connected to the control input for the additional switch through an OR gate.

5. The device of claim 3, including a reference signal circuit for the additional comparator which determines the lower temperature limit, wherein the comparators, the interlock circuit and the reference signal circuit for the additional comparator which determines the lower temperature limit, are connected to the rectifier circuit such that said rectifier circuit is supplied to the comparators, the interlock circuit and reference signal circuit respectively.

6. The device of claim 1, wherein the comparator is constructed to determine the upper temperature limit, and has its reference signal input looped back by means of an interlock circuit.

7. The device of claim 1, wherein the heating unit includes a thermal safety switch protective device, at least two resistors and an elongated metal rail, on one side of which is a ceramic holder with at least one resistor and the temperature sensor is mounted and insulated on the at least one resistor and the at least two resistors are connected in series with the thermal safety switch protective device.

8. The device of claim 7, wherein the heating unit includes a rail whose cross section is U-shaped and the legs of the U are on the side which does not have a resistor, and one of the legs is shorter than the other one.

9. The device of claim 8, wherein along the elongated sheet receiving opening, there is an elongated narrow pivoting flap which serves as a cover for the opening and at the same time includes a means of operating a switch to activate the device.

10. The device of claim 1, wherein the temperature sensor is located at a distance from one end of the heating unit which is greater than ¼ of the (heater's) heating unit's total length.

* * * * *